United States Patent [19]

Corbet et al.

[11] 4,136,625

[45] Jan. 30, 1979

[54] FLAME INJECTION THROATS FOR FURNACES

[75] Inventors: John S. Corbet, Bearsden, Scotland; John Basford, Stoke-on-Trent; James R. Hemming, Solihull, both of England

[73] Assignee: Poulton & Son (Refractories) Limited, Staffordshire, England

[21] Appl. No.: 804,399

[22] Filed: Jun. 7, 1977

[30] Foreign Application Priority Data

Jun. 11, 1976 [GB] United Kingdom ..... 24242/76

[51] Int. Cl.[2] ..... F23M 5/04

[52] U.S. Cl. ..... 431/336; 110/339

[58] Field of Search ..... 110/1 A, 1 B, 336, 339, 110/338, 337; 431/159

[56] References Cited

U.S. PATENT DOCUMENTS

| | | | |
|---|---|---|---|
| 2,463,217 | 3/1949 | Tonneson | 110/1 A |
| 2,769,410 | 11/1956 | Over | 110/1 A |
| 2,854,842 | 10/1958 | Hosbein et al. | 110/1 A |
| 3,765,345 | 10/1973 | Binasik et al. | 110/1 A |

*Primary Examiner*—Edward G. Favors

[57] ABSTRACT

A flame injection throat for a furnace incorporates a furnace structure formed with a flame injection throat opening lined by at least one ring of refractory tiles the adjacent edge portions of the outer faces of selected adjacent tiles are formed with aligned undercut grooves. Pins having enlarged ends are attached to the furnace structure within the throat opening and project into the groove. Locking members fitted into the grooves engage simultaneously the undercut portions of the grooves in the tiles and the enlarged ends of the pins lying within the grooves whereby to hold the tiles to the pins. Each locking member is a block of heat-resisting metal presenting two limbs arranged to straddle a pin projecting into the groove.

10 Claims, 4 Drawing Figures

FLAME INJECTION THROATS FOR FURNACES

Figure 1:
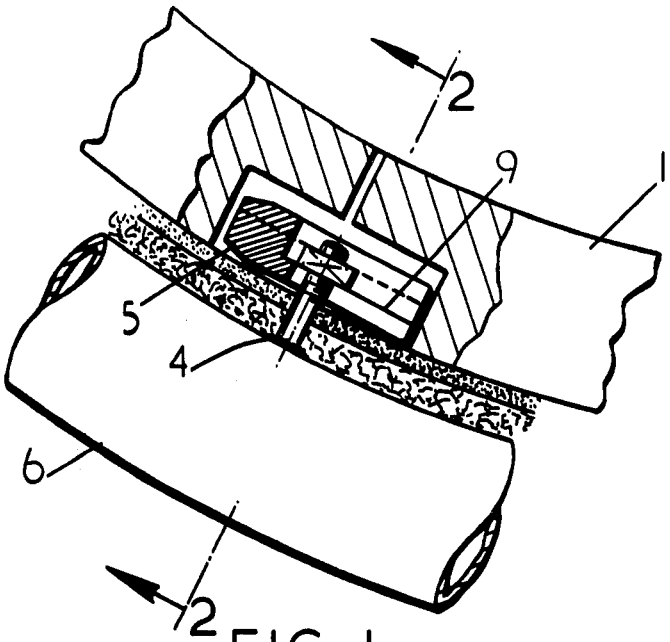

The subject of this invention is a flame injection throat for a furnace.

Furnaces fired by oil, gas and powdered coal usually have the burners fitted outside of the furnaces and project a flame through an injection throat into the furnace. Because of the intense heat generated in the injection throat it is customary for these throats to be lined with refractory material. One early method of providing the refractory lining was to form a monolithic lining in place in the throat but a modern development has been to form the throat in the form of a ring thus providing much the same appearance as a monolithic lining but making it easier to renew the lining when the lining becomes no longer serviceable. The known method of attaching the tiles is to fit them to studs attached to the furnace structure, the studs penetrating holes formed in the tiles and carrying nuts which retain the tiles in place, the nuts being located in recesses which are filled with refractory material. A difficulty associated with this form of construction is that the refractory material filling the recesses in which the nuts are located both corrodes the material of the studs and also becomes firmly embedded in the screw threads so that the nuts cannot be unscrewed from the studs when tile replacement is required. Another drawback is that if the refractory lining deteriorates as sometimes happens and part of the lining falls out the studs are exposed to the heat and often become damaged. When new tiles have to be fitted it is necessary first to break off the old tiles then cut off the studs close to their points of fixing and weld on new studs. As a large furnace throat can carry a large number of tiles with a corresponding large number of studs the operation is time-consuming and costly. It would be of great advantage to be able to replace tiles in the throat without requiring to renew the studs.

It is an object of the present invention to provide a flame injection throat which offers this advantage.

In the following specification the word "ring" is used to denote a closed ring-like structure which may be non-circular, e.g. eliptical or having parallel sides joined by curved ends as well as truly circular structures.

According to the invention a flame injection throat for a furnace incorporating a furnace structure formed with a flame injection throat opening and at least one ring of refractory tiles lining the inner face of the opening in the structure and forming the flame injection throat is characterized in that the adjacent edge portions of the outer faces i.e. the faces adjacent the inner face of the opening in the furnace structure, of selected adjacent tiles are formed with undercut grooves, i.e. grooves wider at the bottom than the top, which extend inwardly from the adjacent end faces of the tiles in alignment with one another, pins having enlarged ends are attached to the furnace structure within the throat opening and project into the grooves in the tiles so that the enlarged ends are within the grooves and locking members are fitted into the grooves and engage simultaneously the undercut portions of the grooves in the tiles and the enlarged ends of the pins whereby to hold the tiles to the pins.

The flame injection throat may incorporate several coaxial rings of refractory tiles the tiles of each ring being attached as described.

One end face of each pair of adjacent end faces presented by adjacent tiles may be formed with a tongue disposed in an axial direction with respect to the throat, the other end face being formed with a groove engaged by the tongue.

Where the furnace throat is formed of several coaxial rings of tiles all the faces of the tiles of one ring forming one end face of the ring of tiles may be formed with tongues, the abutting end faces of the tiles of the other ring being formed with grooves engaged by the tongues.

Alternatively, instead of tongues and grooves the abutting faces of adjacent tiles may be rabetted or stepped into one another.

The undercut grooves may be of dovetail form or may be tee-shaped.

The pins may be screw-threaded pins, the enlarged ends being constituted by nuts screwed on to the ends of the pins. Alternatively the pins may be presented by bolts the enlarged ends being constituted by the heads of the bolts.

Each locking member may be a block, conveniently of heat-resisting metal, bifurcated along a portion of its length whereby to present two limbs arranged when fitted into a groove in a tile to straddle a pin projecting into the groove and simultaneously engage the undercut portion of the groove.

Each limb may be formed with an outwardly projecting flange extending lengthwise of the limb and an inwardly projecting flange also extending lengthwise of the limb the dimensions of the locking member being such that it will fit within the groove in a tile with the outwardly projecting flanges engaging the undercut portion while the limbs straddle a pin projecting into the groove in the tile with the inwardly projecting flanges engaging under the enlarged end of the pin.

Where the grooves in the tiles are of dovetail form, the outer faces of the limbs of the block may also be of dovetail form in cross section.

Refractory sealing material, which may be compressible, in sheet form may be fitted between the adjacent faces of the tiles.

In the accompanying drawings

Figure 2:
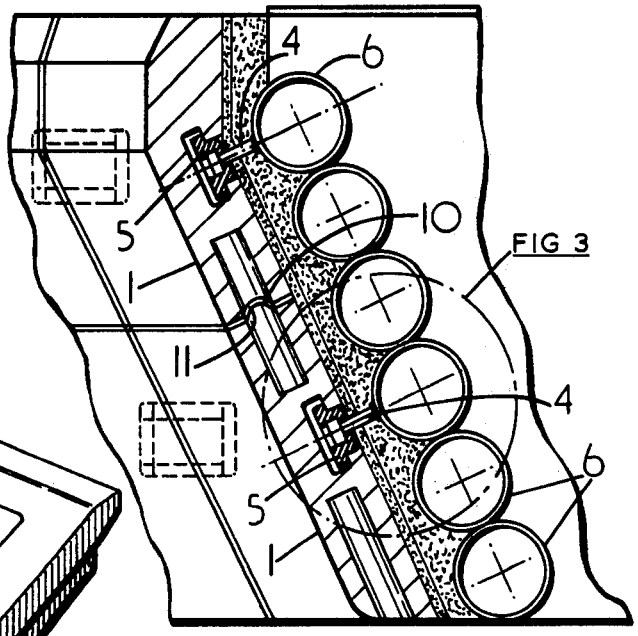
Figure 4:
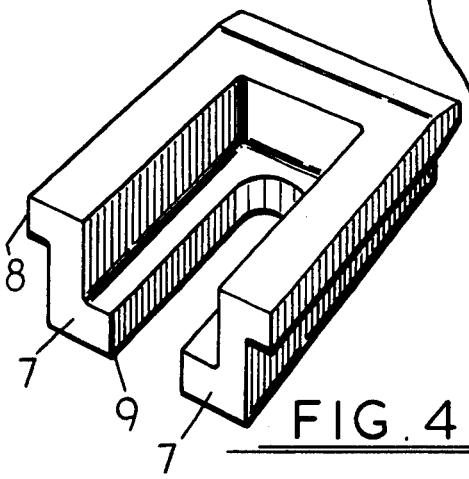
Figure 3:
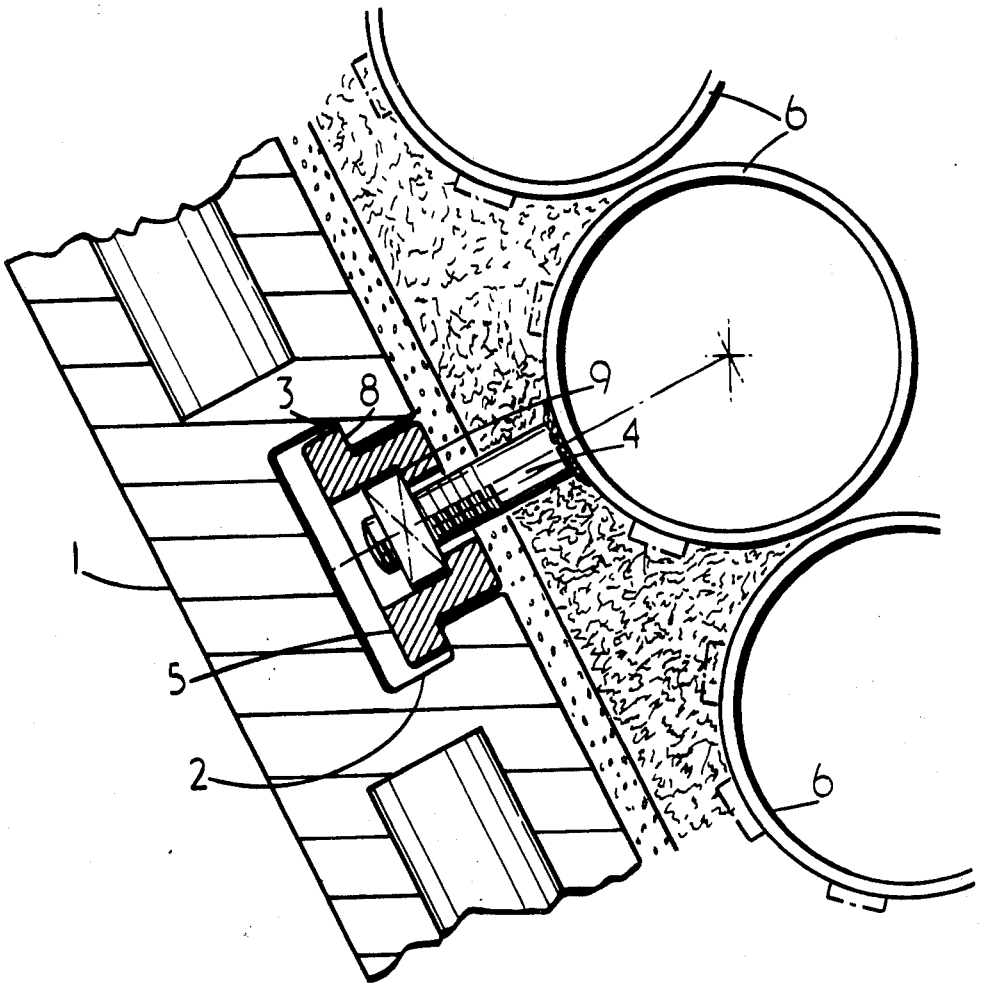

FIG. 1 illustrates a portion of a lining of tiles forming a flame injection throat of a furnace constructed according to the invention, FIG. 2 is a section through the line 2—2 in FIG. 1, FIG. 3 is a view to a larger scale of the portion ringed in FIG. 2 to illustrate the invention more clearly and FIG. 4 is a perspective view of the locking member used in the construction illustrated in FIGS. 1 and 2.

In the drawings 1 denotes several refractory tiles forming part of a ring of tiles lining the inner face of the furnace opening, the complete ring of tiles forming the lining of a flame injection throat. Selected adjacent tiles are formed with grooves 2 open to the outer surfaces of the tiles i.e. the surfaces adjacent the inner face of the furnace opening, said grooves 2 presenting undercut portions 3. The grooves 2 are so located that they extend inwardly into the selected tiles away from the adjacent end faces of the tiles, the adjacent grooves being in alignment with one another when the adjacent tiles are in place forming part of the ring of tiles. 4 denotes pins having enlarged ends constituted by nuts screwed on to the pins attached at one end to the furnace structure, said pins projecting radially into the throat and penetrating the grooves 2 in the tiles where each pin 4 engages a locking member 5 fitted into the grooves 2 in adjacent tiles so that each locking member 5 bridges the gap between the adjacent tiles. In the illustrated construction the part of the furnace structure to which the pins 4 are attached is formed by a ring of pipes 6 surrounding the throat opening. These pipes 6 which are customarily provided where the furnace structure is part of a steam raising or water heating installation serve to convey water to the installation and perform the double purpose of helping to cool the furnace throat and at the same time provide warmed feed water. It is to be understood that in furnaces not associated with water heating or steam raising there may be no tubes surrounding the flame injection throat. In such a situation the pins will be attached to any other conveniently situated portion of the furnace structure. Each locking member 5 comprises a block preferably of heat-resisting metallic material such as cast iron bifurcated along a portion of its length so that it presents two limbs 7 which straddle the associated pin 4 projecting into the groove 3 in the tile to which the locking member 5 is fitted. Each limb 7 is formed with an outwardly projecting flange 8 extending lengthwise of the limb and adjacent one surface of the block and an inwardly projecting flange 9 also extending lengthwise of the limb and adjacent the opposite surface of the block. The block is so dimensioned that when it is fitted into a groove 2 the flanges 8 fit under the undercut portion 3 in the groove while the nut 4A of the pin 4 engages the flanges 9 of the block 5. 10 denotes a tongue on an end face of each tile of one ring engaging a groove 11 in the end face of the adjacent tile of an adjoining ring of tiles.

In practice, a refractory flame injection throat is formed in a furnace opening by attaching pins 4 with enlarged ends constituted in the illustrated construction by nuts 4A within the furnace opening so that the pins 4 project radially inwards and are spaced to suit the dimensions of the tiles 1 so that at least one pin 4 will coincide approximately with the junction of each of selected pairs of adjacent tiles 1. The first tile is fitted in place in the furnace throat so that the respective pins 4 fit into the grooves 2 substantially on the lines of the end faces of the tile. Locking members 5 are pressed into the grooves 2 so that the locking members engage the grooves 2 and at the same time engage below the enlarged heads 4A of the pins 4. Approximately half of each locking member 5 will project from the respective end face of the first tile. The next tile is now applied to each exposed face of the first tile by fitting the said next tile in such a way as to cause the groove 2 at the appropriate face of the tile to fit over the projecting locking member 5 of the tile already in place, i.e. the first tile. The groove extending inwards from the opposite edge face of the newly fitted tile i.e. the edge face remote from the first tile will now fit over the enlarged head of another pin 4. A locking member 5 is now fitted into that groove and this procedure is followed until the ring is completed except for one tile. This tile may be a plain tile or may be a grooved tile like the others but since no pins are fitted at the position of the last tile and no locking members have to be engaged the last tile may be slid into place to complete the ring and because of its completion of the ring this tile remains in place like the keystone of an arch without any attachment other than any grouting which may be applied to lute the flame injection throat. It will be understood that refractory material in sheet form may be inserted between the adjacent faces of the tiles as the tile ring is built up or refractory material may be applied as a lute after the ring is completed.

The locking members 5 isolate the pins 4 from the refractory tiles 1 so that these pins are also much cooler than the tiles when the furnace is in operation. Additionally where the furnace is a boiler furnace as in the illustrated construction the pins are conveniently attached to the feed water tubes normally surrounding the throat and forming part of the furnace structure again as illustrated and are thus additionally cool. As the locking members 5 may be cast from a refractory metal such as cast iron and are robust in construction they are expected to have a life as long as the furnace and if it becomes necessary to replace any of the tiles in the furnace throat the faulty tiles may be driven out and the locking members 5 simply slid off the ends of the pins 4 without damaging the pins. It may be necessary to remove undamaged tiles to facilitate removal and replacement of the damaged tiles but this causes little additional difficulty and the undamaged tiles can be used again. Replacement tiles may then be fitted and the locking members 5 replaced without requiring any replacement of the pins 4.

An additional advantage of the construction of the invention is that since the tile surface is not formed with any recess for providing access to the fixing means requiring subsequent filling with refractory material the tile surface is much smoother than in known constructions employing rings of tiles thus promoting the best conditions for air flow through the throat and the best combustion conditions.

What is claimed is:

1. A flame injection throat for a furnace comprising a furnace structure having an opening and at least one ring of refractory tiles lining the inner face of the opening forming the flame injection throat, the adjacent edge portions of the outer faces of selected adjacent tiles being formed with undercut grooves wider at the bottom than the top, said grooves extending inwardly from the adjacent end faces of the tiles in alignment with one another, pins having enlarged ends attached to the furnace structure within the throat opening and projecting into grooves in the tiles so that the enlarged ends are within the grooves and locking members fitted into the grooves and engaging simultaneously the undercut portions of the grooves in the tiles and the enlarged ends of the pins whereby to hold the tiles to the pins each of said locking members being a block of heat-resisting metal bifurcated along a portion of its length whereby to present two limbs arranged when fitted into a groove in a tile to straddle a pin projecting into the groove and simultaneously engage the undercut portion of the groove.

2. A flame injection throat for a furnace incorporating several coaxial rings of refractory tiles lining the throat opening in which the tiles of at least selected rings are attached as claimed in claim 1.

3. A flame injection throat as claimed in claim 1 in which one end face of each pair of adjacent end faces presented by adjacent tiles is formed with a tongue disposed in an axial direction with respect to the throat, the other end face being formed with a groove engaged by the tongue.

4. A flame injection throat as claimed in claim 2 in which all the faces of the tiles of one ring forming one end face of the ring of tiles are formed with tongues, the abutting end faces of the tiles of the other ring being formed with grooves engaged by the tongues.

5. A flame injection throat as claimed in claim 2 in which the abutting faces of adjacent tiles are stepped into one another.

6. A flame injection throat as claimed in claim 1 in which the undercut grooves are of dovetail form.

7. A flame injection throat as claimed in claim 1 in which the undercut grooves are tee-shaped in cross section.

8. A flame injection throat as claimed in claim 1 in which the pins are screw-threaded pins, and nuts screwed on to the ends of the pins forming the enlarged ends of the pins.

9. A flame injection throat as claimed in claim 1 in which the pins are bolts, the enlarged ends being constituted by the heads of the bolts.

10. A locking member for use in a flame injection throat as claimed in claim 1 wherein each limb is formed with an outwardly projecting flange extending lengthwise of the limb and an inwardly projecting flange also extending lengthwise of the limb the outwardly projecting flanges engaging the undercut portion and the inwardly projecting flanges engaging under the enlarged end of the pin.

* * * * *